US008062095B2

(12) United States Patent
Voges et al.

(10) Patent No.: US 8,062,095 B2
(45) **Date of Patent: *Nov. 22, 2011**

(54) METHOD OF PRODUCING RUST INHIBITIVE SHEET METAL THROUGH SCALE REMOVAL WITH A SLURRY BLASTING DESCALING CELL HAVING IMPROVED GRIT FLOW

(75) Inventors: Kevin C. Voges, Red Bud, IL (US); Alan R. Mueth, Red Bud, IL (US)

(73) Assignee: The Material Works, Ltd., Red Bud, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/887,769

(22) Filed: Sep. 22, 2010

(65) Prior Publication Data

US 2011/0009034 A1 Jan. 13, 2011

Related U.S. Application Data

(63) Continuation-in-part of application No. 12/418,852, filed on Apr. 6, 2009, which is a continuation-in-part of application No. 12/051,537, filed on Mar. 19, 2008, which is a continuation-in-part of application No. 11/531,907, filed on Sep. 14, 2006, now Pat. No. 7,601,226.

(51) Int. Cl.
*B24B 1/00* (2006.01)

(52) U.S. Cl. ..... 451/38; 451/39; 451/81; 451/95; 451/97; 134/6

(58) Field of Classification Search ..... 451/38, 451/39, 40, 81, 89, 94, 95, 97, 336, 907; 134/6, 7

See application file for complete search history.

(56) References Cited

U.S. PATENT DOCUMENTS 2,132,311 A * 10/1938 Minich ..... 451/80

(Continued)

FOREIGN PATENT DOCUMENTS

JP 2007136469 6/2007

OTHER PUBLICATIONS

International Search Report for PCT/US2009/037055 dated May 5, 2009.

(Continued)

*Primary Examiner* — Eileen P. Morgan
(74) *Attorney, Agent, or Firm* — Thompson Coburn LLP

(57) ABSTRACT

A method is provided for removing iron oxide scale from sheet metal and producing a sheet metal surface with rust inhibitive properties. The sheet metal is advanced through the descaling cell and a slurry mixture is propelled against at least one of the top surface and bottom surface of the sheet metal across the sheet metal width as the material is advanced through the descaling cell. The rate of slurry impact against the at least one of the top surface and bottom surface of the sheet metal is controlled in a manner to remove substantially all of the scale from a surface of the sheet metal, and in a manner to create a passivation layer on the descaled surface of the sheet metal. The passivation layer comprises at least one of silicon, aluminum, manganese and chromium and inhibits oxidation of the descaled surface of the processed sheet metal.

22 Claims, 10 Drawing Sheets

U.S. PATENT DOCUMENTS

| | | | | | |
|---|---|---|---|---|---|
| 2,204,588 | A | | 6/1940 | Guite | |
| 2,429,724 | A | | 10/1947 | Barnes | |
| 2,777,256 | A | | 1/1957 | Paasche | |
| 3,543,775 | A | | 12/1970 | Bodnar | |
| 3,731,432 | A | | 5/1973 | Carpenter, Jr. et al. | |
| 3,775,180 | A | | 11/1973 | Hirata et al. | |
| 3,832,809 | A | * | 9/1974 | Carpenter, Jr. et al. | 451/39 |
| 3,905,780 | A | | 9/1975 | Jasper et al. | |
| 3,984,943 | A | | 10/1976 | Kono et al. | |
| 4,251,956 | A | | 2/1981 | Hirata et al. | |
| 4,269,052 | A | * | 5/1981 | Imai et al. | 72/39 |
| 4,449,331 | A | | 5/1984 | MacMillan | |
| 4,561,220 | A | | 12/1985 | Carpenter et al. | |
| 4,723,379 | A | | 2/1988 | Macmillan et al. | |
| 4,751,798 | A | | 6/1988 | McDade | |
| 4,768,314 | A | | 9/1988 | Thomson | |
| 4,907,379 | A | | 3/1990 | MacMillan | |
| 5,092,084 | A | * | 3/1992 | Schlick | 451/95 |
| 5,107,629 | A | | 4/1992 | Boyd et al. | |
| 5,386,668 | A | * | 2/1995 | Mugge et al. | 451/91 |
| 5,554,235 | A | * | 9/1996 | Noe et al. | 148/610 |
| 5,637,029 | A | | 6/1997 | Lehane | |
| 6,088,895 | A | | 7/2000 | Nelson et al. | |
| 6,257,034 | B1 | * | 7/2001 | Fukumori et al. | 72/39 |
| 6,295,852 | B1 | * | 10/2001 | Kipping et al. | 72/39 |
| 6,854,169 | B2 | * | 2/2005 | Love, III et al. | 29/81.06 |
| 7,077,724 | B1 | * | 7/2006 | Voges | 451/38 |
| 7,601,226 | B2 | * | 10/2009 | Voges et al. | 134/6 |
| 2004/0069034 | A1 | * | 4/2004 | Seidel | 72/39 |
| 2005/0116397 | A1 | | 6/2005 | Kimura et al. | |
| 2008/0182486 | A1 | | 7/2008 | Voges | |
| 2009/0002686 | A1 | * | 1/2009 | Voges et al. | 356/73 |
| 2009/0227184 | A1 | | 9/2009 | Voges et al. | |

OTHER PUBLICATIONS

International Search Report for PCT/US2010/026595 dated May 3, 2010.

* cited by examiner

METHOD OF PRODUCING RUST INHIBITIVE SHEET METAL THROUGH SCALE REMOVAL WITH A SLURRY BLASTING DESCALING CELL HAVING IMPROVED GRIT FLOW

RELATED APPLICATION DATA

This patent application is a continuation-in-part of patent application Ser. No. 12/418,852, filed Apr. 6, 2009, currently pending; which is a continuation-in-part of patent application Ser. No. 12/051,537, filed on Mar. 19, 2008, currently pending, which is a continuation-in-part of patent application Ser. No. 11/531,907, filed on Sep. 14, 2006, now U.S. Pat. No. 7,601,226, issued Oct. 13, 2009; the disclosures of which are incorporated by reference herein.

BACKGROUND OF THE INVENTION

The disclosure pertains to a process for removing undesirable surface material from flat materials either in sheet or continuous form, and from narrow tubular material. In particular, the disclosure pertains to an apparatus and method for removing scale from the surfaces of processed sheet metal or metal tubing by propelling a scale removing medium, specifically, a liquid/particle slurry, against the surfaces of the material passed through the apparatus, and controlling the slurry blasting process in a manners to produce a resultant material that exhibits rust inhibitive properties.

As will be described in further detail below, the methods and apparatuses disclosed herein provide advantages over the apparatuses and methods used in the prior art. Sheet steel (a.k.a. flat roll) is by far the most common type of steel and is far more prevalent than bar or structural steel. Before sheet metal is used by manufacturers it is typically prepared by a hot rolling process. During the hot rolling process, carbon steel is heated to a temperature in excess of 1,500° F. (815° C.). The heated steel is passed through successive pairs of opposing rollers that reduce the thickness of the steel sheet. Once the hot rolling process is completed, the processed sheet metal or hot rolled steel is reduced in temperature, typically by quenching it in water, oil, or a polymer liquid, all of which are well known in the art. The processed sheet metal is then coiled for convenient storage and transportation to the ultimate user of the processed sheet metal, i.e. the manufacturers of aircraft, automobiles, home appliances, etc.

During the cooling stages of processing the hot rolled sheet metal, reactions of the sheet metal with oxygen in the air and with the moisture involved in the cooling process can result in the formation of an iron oxide layer, commonly referred to as "scale," on the surfaces of the sheet metal. The rate at which the sheet metal is cooled, and the total temperature drop from the hot rolling process effect the amount and composition of the scale that forms on the surface during the cooling process.

In most cases, before the sheet metal can be used by the manufacturer, the surface of the sheet metal must be conditioned to provide an appropriate surface for the product being manufactured, so that the sheet metal surface can be painted or otherwise coated, for example, galvanized. The most common method of removing scale from the surface of hot rolled or processed sheet metal is a process known as "pickling and oiling." In this process, the sheet metal, already cooled to ambient temperature following the hot rolling process, is uncoiled and pulled through a bath of hydrochloric acid to chemically remove the scale formed on the sheet metal surfaces. Following removal of the scale by the acid bath, the sheet metal is then washed, dried, and immediately "oiled" to protect the surfaces of the sheet metal from oxidation or rust. The oil provides a film layer barrier to air that shields the bare metal surfaces of the sheet metal from exposure to atmospheric air and moisture.

Virtually all flat rolled steel is pickled and oiled. Because flat rolled steel is so commonly used—it is typically used in automobiles, appliances, construction, and nearly all of our agricultural implements—pickling and oiling, either as an end result pickled product or pickled to produce other common materials such as cold roll, prepaint, galvanize, electro galvanize, etc, is also very common. To illustrate the scope of the practice, one of the largest steel producers in the world operates a very large steel mill that has 16 pickle lines each running about 90,000 monthly tons. Some estimate that there are approximately 100 pickle lines in the U.S. alone with several thousand more located abroad.

The "pickling" portion of the process is effective in removing substantially all of the oxide layer or scale from processed sheet metal. However, the "pickling" portion of the process has a number of disadvantages. For example, the acid used in the acid bath is corrosive; it is damaging to equipment, it is hazardous to people, and is an environmentally hazardous chemical which has special storage and disposal restrictions. In addition, the acid bath stage of the process requires a substantial area in the sheet metal processing facility. Pickling lines are typically about 300-500 feet long, so they take up an enormous amount of floor space in a steel mill. Their operation is also very expensive, operating at a cost of approximately $12/ton-$15/ton. A "pickling and oiling" line with a tension leveler costs approximately $18,000,000.00. Also, it is critical that the sheet metal be oiled immediately after the pickling process, because the bare metal surfaces will begin to oxidize almost immediately when exposed to the atmospheric air and moisture. Oftentimes, free ions from the acid solution (i.e., $Cl^-$) remain on the surface of the metal after the pickling portion of the process, thereby accelerating oxidation unless oiled immediately.

Oiling is also effective in reducing oxidation of the metal as it shields the bare metal surfaces of the sheet metal from exposure to atmospheric air and moisture. However, oiling also has disadvantages. Applying and subsequently removing oil takes time and adds substantial cost both in terms of material cost of the oil product itself, and in terms of the labor to remove oil before subsequent processing of the steel. Like the pickling acid, oil is an environmentally hazardous material with special storage and disposal restrictions. Oil removal products are usually flammable and likewise require special controls for downstream users of the steel product. Also, again, it is critical that the sheet metal be oiled immediately after the pickling process, because the bare metal surfaces will begin to oxidize almost immediately when exposed to the atmospheric air and moisture.

The methods and apparatuses disclosed herein eliminate pickling lines and the need to put oil on the product after pickling. The methods and apparatuses disclosed herein produce a rust inhibitive product, whereas conventional shot blasting and other blasting techniques do not produce a resultant product with rust inhibitive properties, and thus do not replace the need for pickling and oiling. A processing line incorporating the methods and apparatuses disclosed herein avoids the many disadvantages of a pickling and oiling line. For instance, a processing line incorporating the methods and apparatuses disclosed herein is about 100 feet long, thereby saving significant space in a facility. The methods and apparatuses disclosed herein allow for recycling of many of the materials used in the process, without the use of harmful chemicals and acids. Operating costs associated with a processing line using the methods and apparatuses disclosed herein are $7/ton-$10/ton, which is significantly lower than the operating costs of approximately $12/ton-$15/ton associated with a "pickling and oiling" line. The capital cost of a typical line utilizing the methods and apparatuses disclosed herein is about $6,000,000.00, whereas the capital costs for a typical pickling line are about $18,000,000.00.

BRIEF DESCRIPTION OF THE DRAWINGS

Further features of the apparatuses and methods described herein are set forth in the following detailed description and in the drawing figures.

DETAILED DESCRIPTION OF THE PREFERRED EMBODIMENT

Figure 1:
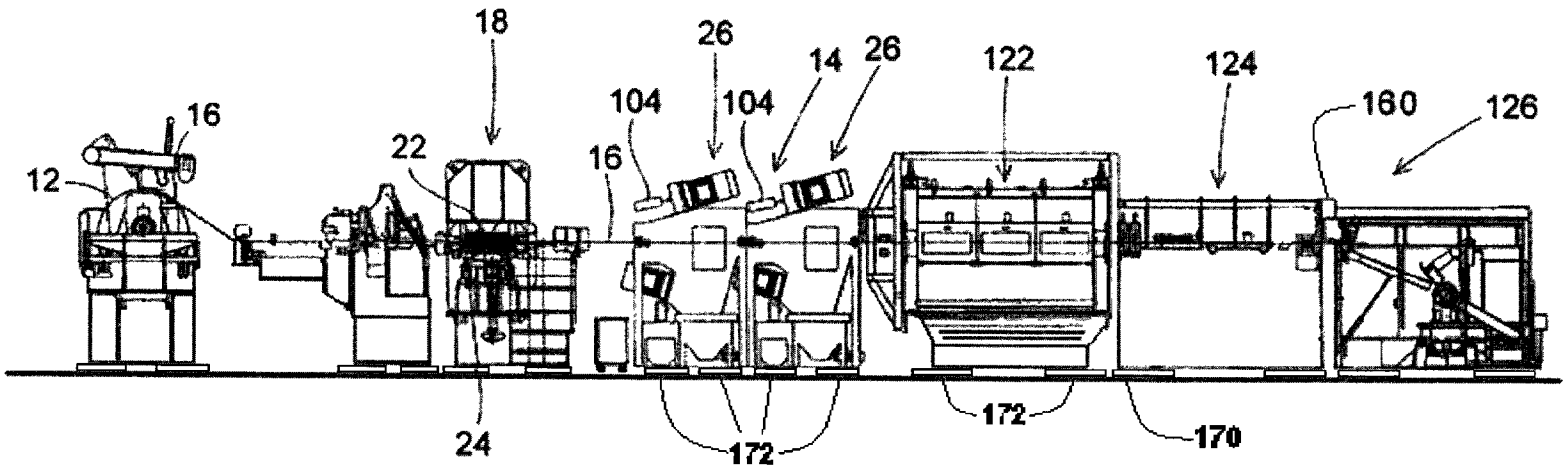
FIG. 1 is a schematic representation of a side elevation view of the processed sheet metal descaling apparatus of the invention and its method of operation.

FIG. 1 shows a schematic representation of one embodiment of a processing line incorporating a slurry blasting descaling cell that removes scale from the surfaces of processed sheet metal and produces a rust inhibitive material. As will be explained, the sheet metal moves in a downstream direction through the apparatus from left to right as shown in FIG. 1. The component parts of the apparatus shown in FIG. 1 and as described below comprise but one embodiment of such a processing line. It should be understood that variations and modifications could be made to the line shown and described below without departing from the intended scope of protection provided by the claims of the application.

Referring to FIG. 1, a coil of previously processed sheet metal (for example hot rolled sheet metal) 12 is positioned adjacent the apparatus 14 for supplying a length of sheet metal 16 to the apparatus. The coil of sheet metal 12 may be supported on any conventional device that functions to selectively uncoil the length of sheet metal 16 from the roll 12 in a controlled manner. Alternatively, the sheet metal could be supplied to the apparatus as individual sheets.

A leveler 18 of the apparatus 14 is positioned adjacent the sheet metal coil 12 to receive the length of sheet metal 16 uncoiled from the roll. The leveler 18 is comprised of a plurality of spaced rolls 22, 24. Although the a roller leveler is shown in the drawing figures, other types of levelers may be employed in the processing line of FIG. 1. Additionally, the processing line may be configured as described in co-pending application Ser. No. 12/332,803, filed Dec. 11, 2008, the disclosure of which is incorporated herein by reference.

From the leveler 18, the length of processed sheet metal 16 passes into the descaler or descaling cell 26. In FIG. 1, a pair of descaling cells 26, consisting of two matched pairs of centrifugal impeller systems, with one pair being installed to process each of the two flat surfaces of the strip are shown sequentially arranged along the downstream direction of movement of the sheet metal 16. Both of the descaler cells 26 are constructed in the same manner, and therefore only one descaler cell 26 will be described in detail. The number of descaler cells is chosen to match the desired line speed of the sheet metal, and ensuring adequate removal of scale and subsequent adjustment of surface texture. While a slurry blasting descaling cell comprising a system of centrifugal impellers is described below, it should be appreciated that a descaling cell may comprise other mechanisms for slurry blasting the processed sheet metal, for instance, a plurality of nozzles.

Figure 2:
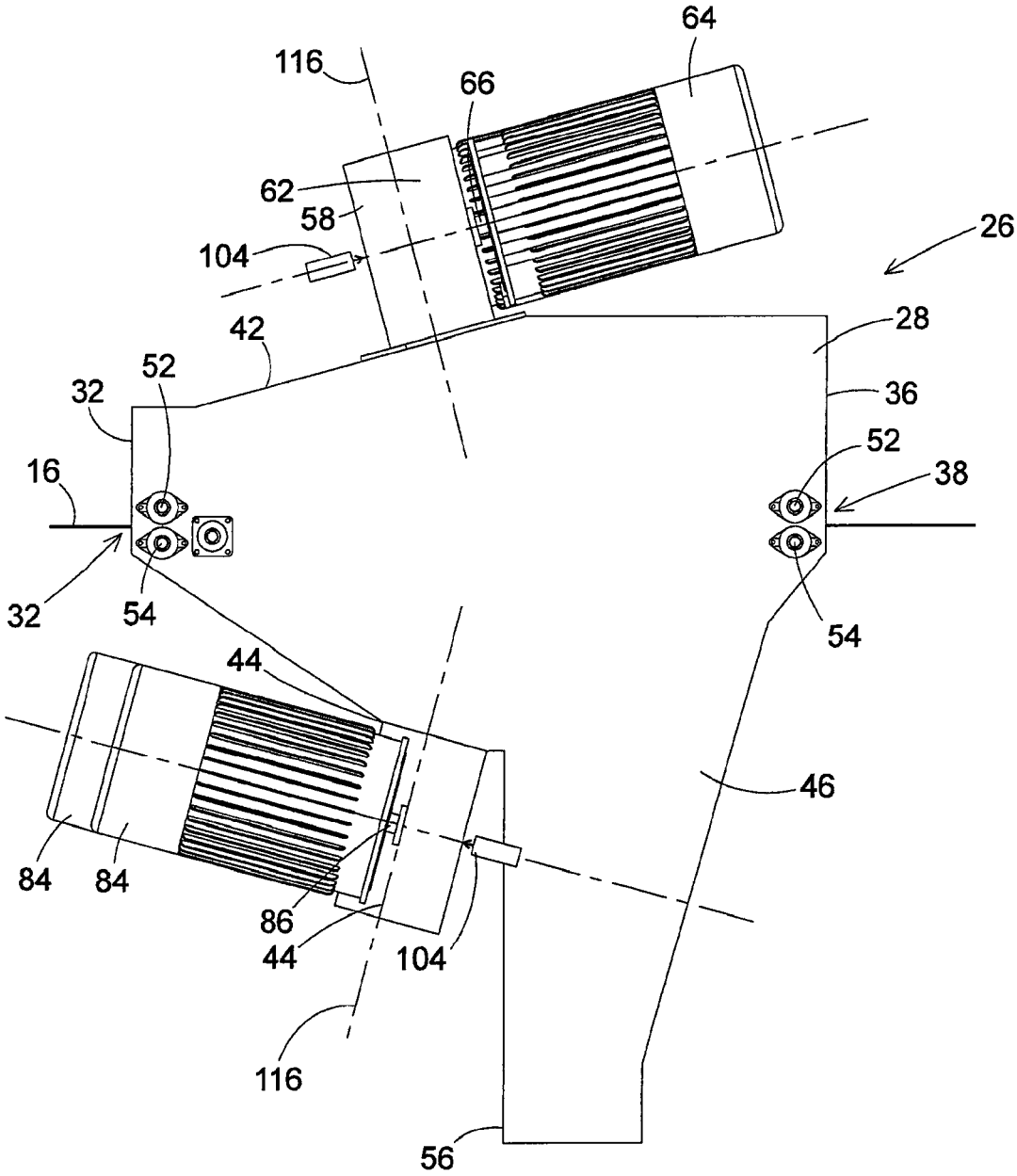
FIG. 2 is a side elevation view of a descaler of the apparatus of FIG. 1.
Figure 5:
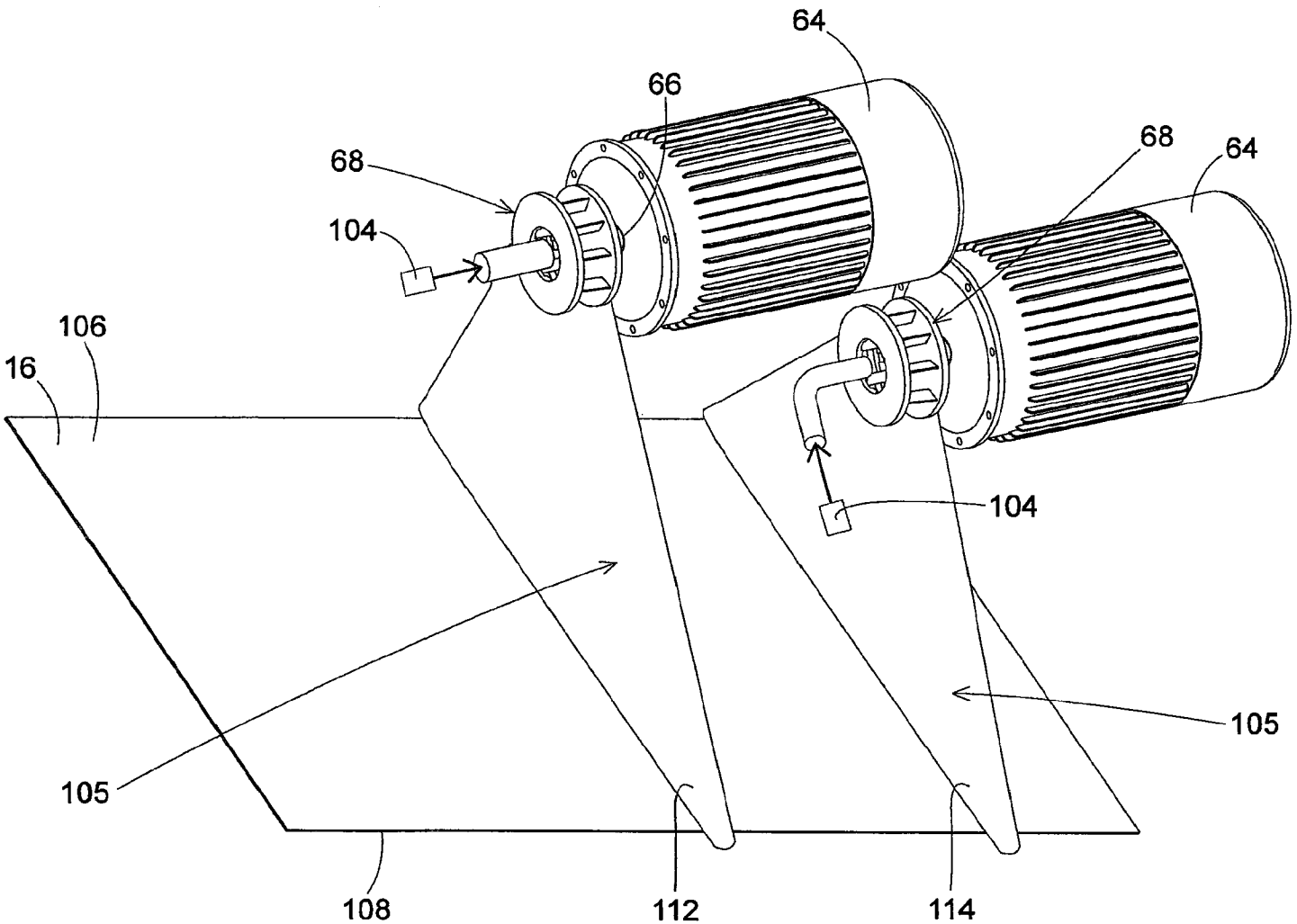
FIG. 5 is a representation of a portion of the descaler shown in FIGS. 3 and 4.
Figure 6:
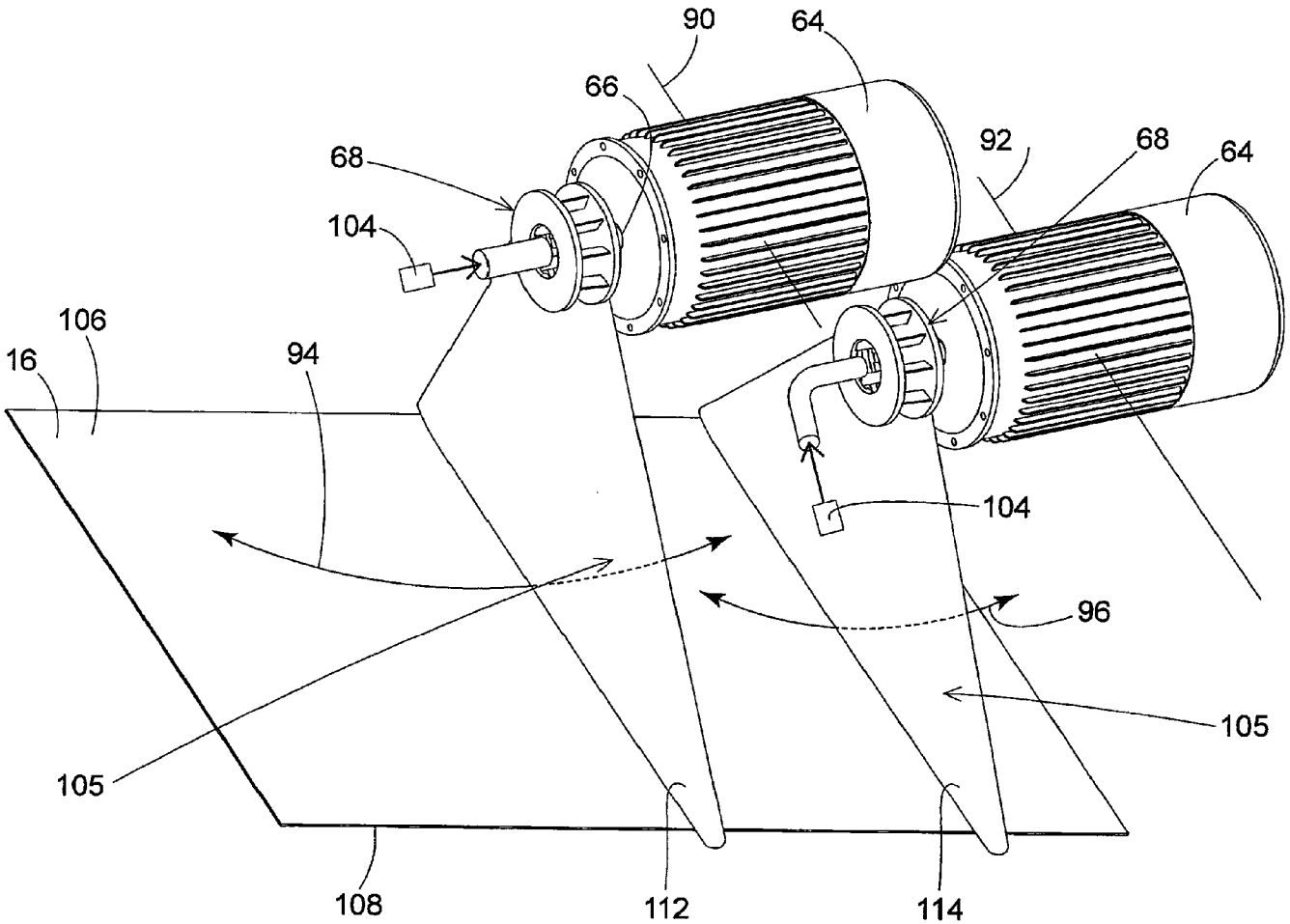
FIG. 6 is a representation of a further portion of the descaler shown in FIGS. 3 and 4.

FIG. 2 shows an enlarged side elevation view of a descaler 26 removed from the apparatus shown in FIG. 1. In FIG. 2, the downstream direction of travel of the length of sheet metal is from left to right. The descaler 26 comprises a hollow box or enclosure 28. A portion of the length of sheet metal 16 is shown passing through the descaler enclosure or box 28 in FIGS. 5-7. The length of sheet metal 16 is shown oriented in a generally horizontal orientation as it passes through the descaler enclosure or box 28. It should be understood that the horizontal orientation of the sheet metal 16 shown in the drawing figures is one way of advancing the sheet metal through the descaling cell, and the sheet metal may be oriented vertically, or at any other orientation as it passes through the descaler apparatus. Therefore, terms such as "top" and "bottom," "above" and "below," and "upper" and "lower" should not be interpreted as limiting the orientation of the apparatus or the relative orientation of the length of sheet metal, but as illustrative and as referring to the orientation of the elements shown in the drawings.

Figure 3:
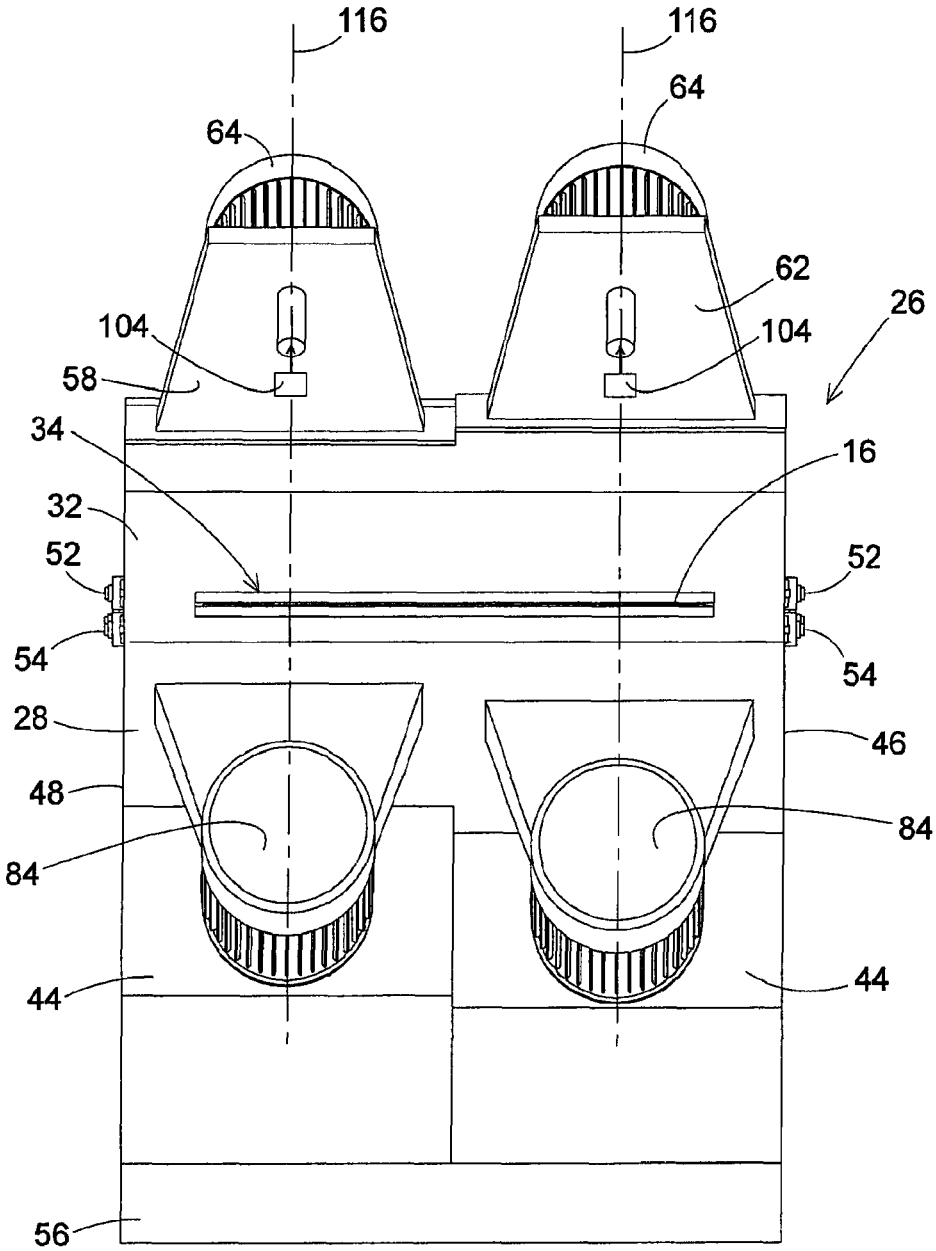
FIG. 3 is an end elevation view of the descaler from an upstream end of the descaler.
Figure 4:
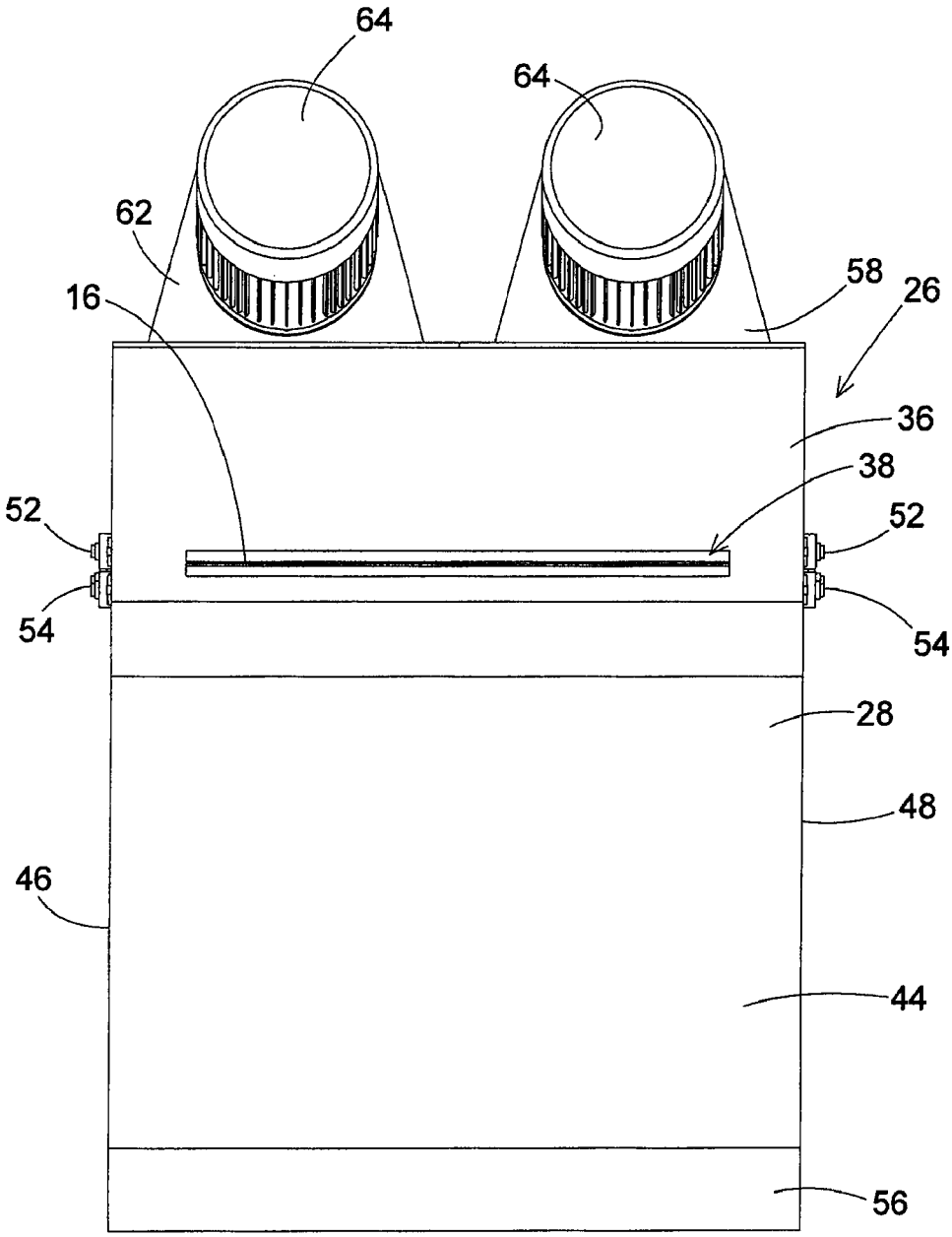
FIG. 4 is an end elevation view of the descaler from the downstream end of the descaler.

An upstream end wall 32 of the enclosure or box 28 has a narrow entrance opening slot 34 to receive the width and thickness of the length of sheet metal 16. An opposite downstream end wall 36 of the box has a narrow slot exit opening 38 that is also dimensioned to receive the width and thickness of the length of sheet metal 16. The entrance opening 34 is shown in FIG. 3, and the exit opening 38 is shown in FIG. 4. The openings are equipped with sealing devices engineered to contain the slurry within the enclosure or box during the processing of the sheet metal. The descaler box 28 also has a top wall 42, a series of bottom wall panels 44, and a pair of side walls 46, 48 that enclose the interior volume of the enclosure or box. For clarity, in the drawings, the interior of the enclosure or box 28 is basically left open, except for pairs of opposed rollers 52,54 that support the length of sheet metal 16 as the length of sheet metal passes through the box interior from the entrance opening 34 to the exit opening 38. In many cases, it may be preferable to use a retracting support device to assist in threading the ends of strips through the machine. The bottom of the box 28 is formed with a discharge chute 56 having a discharge that opens to the interior of the box. The discharge chute 56 allows the discharge of material removed from the length of sheet metal 16 and the collection of used slurry from the interior of the box 28.

A pair of driven centrifugal impellers 68 are installed in lined casings, shrouds or cowlings 58, 62 (see FIGS. 2-4) which are mounted to the box top wall 42. The shrouds 58, 62 have hollow interiors that communicate through openings in the box top wall 42 with the interior of the box. As shown in FIGS. 3-7, the impellers 68 and their respective shrouds 58, 62 are not positioned side by side, but are positioned on the box top wall 42 in a staggered arrangement or spaced apart arrangement along the direction of advancement of the sheet metal through the descaler. The staggered arrangement is preferred to ensure that the slurry discharging from one impeller does not interfere with the slurry from the other impeller of the pair.

A pair of electric motors 64 is mounted on the pair of shrouds 58, 62. Each of the electric motors 64 has an output shaft 66 that extends through a wall of its associated shroud 58, 62 and into the interior of the shroud. Impeller wheels 68 (FIGS. 5-7) are mounted on each of the shafts 66 in the shrouds. The impeller wheels and their associated shrouds may be similar in construction and operation to the slurry discharge heads disclosed in the U.S. patents of MacMillan (U.S. Pat. Nos. 4,449,331, 4,907,379, and 4,723,379), Carpenter et al. (U.S. Pat. No. 4,561,220), McDade (U.S. Pat. No. 4,751,798), and Lehane (U.S. Pat. No. 5,637,029), all of which are incorporated herein by reference.

Figure 8:
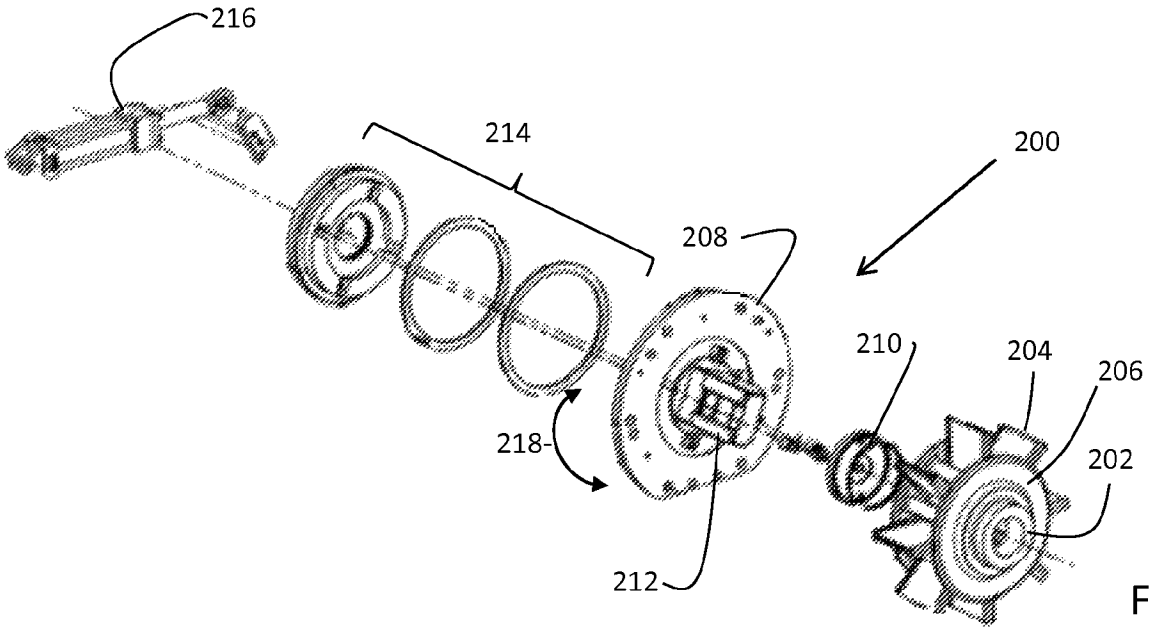
FIG. 8 is an exploded, perspective view of a blast wheel used in the descaler of FIGS. 1-7.

FIG. 8 shows an exploded perspective view of one embodiment of a blast wheel 200 that may be used in the descaling cells described previously. The blast wheel 200 may have a center hub 202 with a plurality of vanes 204 extending radially from the hub. A circular backing plate 206 may be arranged on an axial side of the hub. The circular backing plate 206 may abut a side edge of each of the vanes as the circular backing plate extends radially outward from the hub and provide for a labyrinth rear seal for the blast wheel when mounted in the housing (not shown in FIG. 8). Axially opposite the hub 202, a centering plate assembly 208 forms a front seal for the blast wheel when the components are mounted in the blast wheel housing. An impeller 210 disposed in the center of the hub directs slurry to the vanes 204. A nozzle 212 fits within the impeller 210 and directs slurry from the feed tube (not shown) to the impeller. A feed tube support ring and seal assembly 214 provides for a seal between the nozzle and the runner head.

An actuator 216 is operatively connected to the nozzle 212 and allows the nozzle to be adjustably positioned or rotated in the direction of arrow 218 within the impeller to selectively adjust the blast pattern. In selectively rotating the nozzle outlet within the impeller, the slurry will exit the impeller at a different position relative to the vanes thereby allowing for adjustment of the center of intensity of the blast pattern. For instance, when processing narrower width sheet metal strips in the descaling cells, the nozzle outlet 212 may be rotated within the impeller 210 of each blast wheel such that the center of intensity of the blast pattern is directed more toward the center of the strip of sheet metal (i.e., the center of intensity of the blast pattern of one wheel is moved toward the center of intensity of the blast pattern of the other wheel). Similarly, when processing wider width sheet metal strips in the descaling cells, the nozzle outlet may be rotated within the impeller of each blast wheel such that the center of intensity of the blast pattern is directed more toward the sides of the strip of sheet metal (i.e., the center of intensity of the blast pattern of one wheel is moved away the center of intensity of the blast pattern of the other wheel). Using the actuator 216 to adjustably position the nozzle outlet 212 in the impeller 210 of each wheel to enable selective positioning of the center of intensity of the blast pattern on the sheet metal, and/or controlling the sheet metal advancement rate, as necessary, allows removing substantially all of the scale from the surface of the sheet metal and/or adjusting surface finish. Generally speaking, adjusting the blast pattern allows a narrower width sheet metal strip to be advanced through the descaling cell faster relative to a wider width sheet metal strip for a given slurry discharge rate (i.e., impact velocity) and surface finish requirement. Although the processing speed for advancing a wider width strip of sheet metal through the descaler may be relatively slower than for a narrower width strip of sheet metal, adjustably positioning the nozzle relative to the impeller to selectively position the blast pattern alleviates the need to adjust the motor/blast wheel assemblies on the enclosures of the descaler units, and as such, the motor/blast wheel assemblies may be fixed in position on the enclosures of the descaler units, and slide assemblies for the motor/blast wheel assemblies on the enclosures may eliminated.

The descaling cell impeller wheels and their associated shrouds may be formed from a high strength corrosion resistant material. The descaling cell impeller wheels and their associated shrouds may also be coated with a polymer material to increase the release characteristics of the slurry being propelled from the vanes of the impeller, to increase wear resistance to the grit component of the slurry, and improve the impeller wheel's temperature stability and resistance to chemical oxidation. One type of polymer that has proven effective is a metallic hybrid polymer supplied by Superior Polymer Products of Calumet, Mich., under the designation SP8000MW. A polymer known commercially as Duralan has also been found effective.

Figure 7:
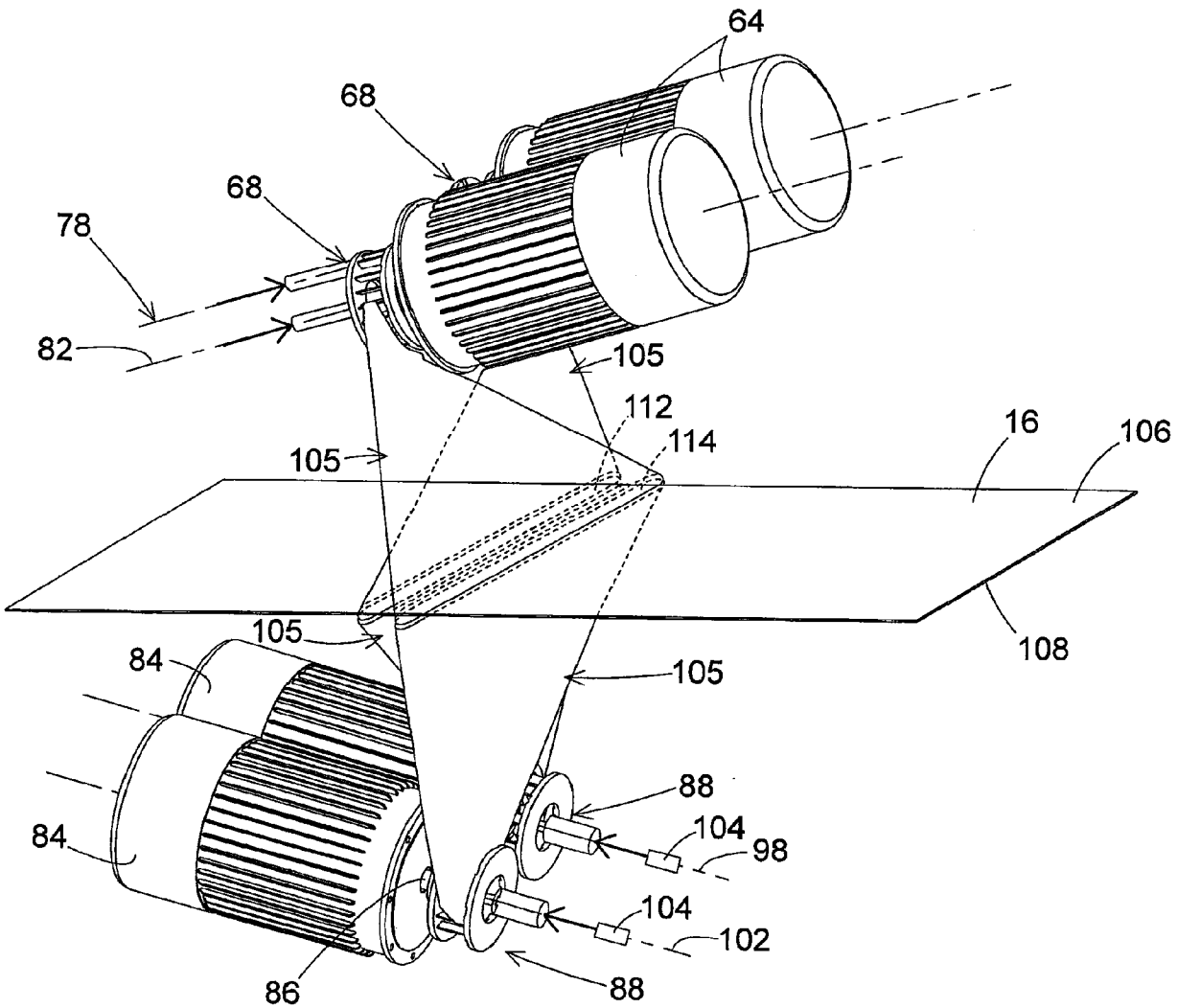
FIG. 7 is a representation of a further portion of the descaler shown in FIGS. 3 and 4.

As shown in FIG. 3 and FIG. 7, a second pair of centrifugal slurry impellers 88 is mounted to bottom wall panels 44 of the descaler box 28. The units will be identical in basic function and size to the top pair. Both the axes 78, 82 of first pair of impellers 68 and the axes 98, 102 of the second pair 88, and their respective assemblies may be mounted to the descaler box 28 oriented at an angle relative to the direction of the length of sheet metal 16 passing through the descaler box 28. The axes 98, 102 of the second pair of motors 84 may also be oriented at an angle relative to the plane of the length of sheet metal 16 passing through the descaler cell 28. This angle may be selected to ensure a stable flow of slurry, to reduce interference between rebounding particles and those that have not yet impacted the strip surface, to improve the scouring action of the abrasive, to improve effectiveness of material removal, and to reduce the forces that would tend to embed material into the strip that would have to be removed by subsequent impacts. Although fixing the blast wheel motor and adjusting the nozzle outlet position in the impeller has been found useful in adjusting the blast pattern, as described above, in a variant embodiment of the apparatus, the pair of motors 84 can be simultaneously adjustably positioned about a pair of axes 90, 92 that are perpendicular to the axes 78, 82 of rotation of the impellers 68 to adjust the angle of impact of the scale removing medium with the surface of the sheet metal 16. This adjustable angle of impact is represented by the curves 94, 96 shown in FIG. 6. Referring to FIG. 1, the axes of rotation of the motors 26 shown in FIG. 1 are oriented at an angle of substantially 20 degrees relative to the surface of the strip 16 moving through the apparatus. In a variant embodiment, the positions of the motors 26 may be adjustable to vary the angle of the slurry blast projected toward the surface of the strip 16 from directly down at the strip surface (i.e., the axes of rotation of the motors 26 being parallel with the surface of the strip 16) to an approximate angle of 60 degrees between the axes of rotation of the motors 26 and the strip surface 16. Although the electric motors 62, 84 are shown in the drawings as the motive source for the descaling wheels 68, 88, other means of rotating the descaling wheels 68, 88 may be employed. For instance, hydraulically operated motors may be used. Hydraulic motors of comparable capacity and horsepower tend to be smaller in size thus reducing the movable mounts and positioning and/or pivoting means requirements of the motors on the box enclosures.

A supply of slurry mixture 104 communicates with the interiors of each of the shrouds 58, 62 in the central portion of the descaling wheels 68, 84 and may be injected into the impeller wheel in the manner described in the earlier-referenced Lehane patent, or being injected through an elliptical nozzle at the side of the impeller wheel. The supply of the scale removing medium 104 is shown schematically in FIG. 3 to represent the various known ways of supplying the different types of abrasive slurry removing medium to the interior of the descaler box 28.

The upper pair of descaling wheels 68 propels the slurry 105 downwardly toward the length of sheet metal 16 passing through the descaler cell 28 impacting with the top surface 106 and removing scale from the top surface. In one embodiment, each pair of descaling wheels will rotate in opposite directions. For example, as the length of sheet metal 16 moves in the downstream direction, if the descaling wheel 68 on the left side of the sheet metal top surface 106 has a counter-clockwise rotation, then the descaling wheel 68 on the right side of the sheet metal top surface 106 has a clockwise rotation. This causes each of the descaling wheels 68 to propel the slurry 105 into contact with the top surface 106 of the length of sheet metal 16, where the contact area of the slurry 105 propelled by each of the descaling wheels 68 extends entirely across, and slightly beyond the width of the length of sheet metal 16. Allowing the discharge of the impeller wheels to extend slightly beyond the edges of the strip ensures the most uniform coverage. This is depicted by the two almost rectangular areas of impact 112, 114 of the scale removing medium 105 with the top surface of the length of sheet metal 16 shown in FIGS. 5, 6 and 7. Because the direction of travel of the slurry propelled by wheels relative to the strip width direction varies with the discharge position of the slurry across the wheel diameter, there may be some directionality to the resulting texture for positions of slurry impact most distant from the wheel. This may be compensated for by the use of pairs of wheels rotating in opposite directions so that each section of the strip is first subjected to the slurry discharge of the first wheel, then any directional effects due to the first discharged slurry are compensated for and countered by opposite impact pattern generated by slurry discharged from the second wheel operating with a reverse rotational direction. Also, the slurry impact density on the processed sheet metal will be greater in areas located closer to the impeller wheel, and gradually across the sheet metal, the density will decrease. Again, using axially spaced apart impeller wheels rotating in opposite directions will produce side-by-side mirror image slurry impact density patterns across the width of the sheet metal thereby providing a uniform blast pattern across the width of the material.

The axially staggered positions of the upper pair of wheels 68 also axially spaces the two impact areas 112, 114 on the surface 106 of the sheet metal. This allows the entire width of the sheet metal to be impacted by the slurry without interfering contact between the slurry propelled from each wheel 68. In addition, the pairs of descaling wheels 68, 88 may be adjustably positioned toward and away from the surface 106 of the sheet metal passing through the descaler. This would provide a secondary adjustment to be used with sheet metal of different widths. By moving the motors 64 and wheels 68 away from the surface 106 of the sheet metal, the widths of the impact areas 112, 114 with the surface 106 of the sheet metal may be increased. By moving the motors 64 and their wheels 68 toward the surface 106 of the sheet metal, the widths of the impact areas 112, 114 with the surface 106 of the sheet metal may decreased. This adjustable positioning of the motors 64 and their descaling wheels 68 enables the apparatus to be used to remove scale from different widths of sheet metal. An additional method of width adjustment of the area of slurry impact with the sheet metal surface is to move the angular position of the inlet nozzles 104 relative to the impeller casing/shroud. A third option is to rotate the pair of impellers about axes 116 normal to their rotation axes relative to the strip travel direction so that the oval area of slurry impact from each wheel, although staying the same length, would not be square or transverse to the sheet metal travel direction. The movement away and toward the strip will also change the impact energy of the flow, and consequently, the effectiveness of the scale removal and surface conditioning for producing rust inhibitive material. A fourth option as described above is to adjustably position the inlet nozzle to the blast wheel relative to the impeller. In each case, the slurry preferably removes substantially all of the scale from the surface of the sheet metal.

In addition, the angled orientation of the axes 78, 82 of the descaling wheels 68 also causes the impact of the slurry 105 to be directed at an angle relative to the surface of the sheet metal 16. The angle of the impact of the slurry 105 with the surface of the sheet metal 16 is selected to optimize the effectiveness of the scale removal and surface conditioning for producing rust inhibitive material. An angle of 15 degrees has been proven satisfactory.

As shown in FIGS. 3 and 7, the lower pair of descaling wheels 88, direct the scale removing slurry 105 to impact with the bottom surface 108 of the length of sheet metal 16 in the same manner as the top pair of descaling wheels 68. In this configuration the areas of impact of the scale removing medium 105 on the bottom surface 108 of the length of sheet metal 16 is directly opposite the areas of impact 112, 114 on the top surface of the sheet metal. This balances the strip loads from the top and bottom streams of slurry to improve line tension stability. Thus, the bottom descaling wheels 88 function in the same manner as the top descaling wheels 68 to remove scale from the bottom surface 108 of the sheet metal 16 passed through the descaler 26, and may be positionable in the same way as the top surface impeller wheels as described above.

Preferably, the top surface and/or bottom surface impeller wheels 68, 88 operate at a wheel velocity which is relatively lower than wheel velocities using in conventional grit blasting operations. Preferably, the top surface and/or bottom surface impeller wheels 68, 88 rotate to generate a slurry discharge velocity below 200 feet per second. More preferably, the slurry discharge velocity is in arrange of about 100 feet per second to 200 feet per second. Even more preferably, the slurry discharge velocity is in arrange of about 130 feet per second to 150 feet per second. In conventional shot blasting, the discharge velocity of the grit is greater than 200 feet per second, and may be as high as 500 feet per second. The inventors have discovered that by slurry blasting at a low velocity, and controlling other operating parameters as discussed below, the processed sheet metal may exhibit rust inhibitive properties after passing through the descaling cell with substantially all of the scale removed thereby obviating the need for secondary processing, for instance, pickling and oiling.

Another operating parameter, which the inventors have found to be important in processing the sheet metal so that the sheet metal exhibits rust inhibitive properties, relates to the type and amount of grit used in the slurry mixture. The type and amount of grit along with the discharge velocity of the slurry mixture are preferably controlled to allow the descaling cell to produce a rust inhibitive processed sheet metal with a commercially acceptable surface finish (i.e., roughness). Controlling the type and amount of grit along with the discharge velocity of the slurry mixture reduces the probability of scale or grit particles being imbedded into the softer steel surface of the processed sheet metal. A relatively low wheel velocity for propelling the slurry and an angular grit has been found efficient in removing the scale oxide layers from the processed sheet metal strip and producing rust inhibitive properties for the processed sheet metal. By propelling the slurry at velocities below 200 feet per second, the angular grit will not fracture to a significant extent, and will gradually become rounded in configuration as it is spent through repeated impact with the processed steel sheet. The rounding of the grit that occurs in the descaling process results in some of the grit becoming smaller in size. A blend of grit sizes assists in ensuring more uniform surface coverage of the processed sheet metal.

With the foregoing in mind, forming the slurry mixture from water and a steel grit having a size range of SAE G80 to SAE G40 has proven effective. Forming the slurry mixture from water and a steel grit having a size of SAE G50 has also proven effective. To ensure the efficacy of the slurry mixture, the grit to water ratio is preferably monitored and controlled. A grit-to-water ratio of about 2 pounds to about 15 pounds of grit for each gallon of water has proven effective. A grit-to-water ratio of about 4 pounds to about 10 pounds of grit for each gallon of water has also proven effective. A grit flow rate of about 2500 pounds per minute to 5000 pounds per minute per blasting wheel has also proven effective.

Figure 9:
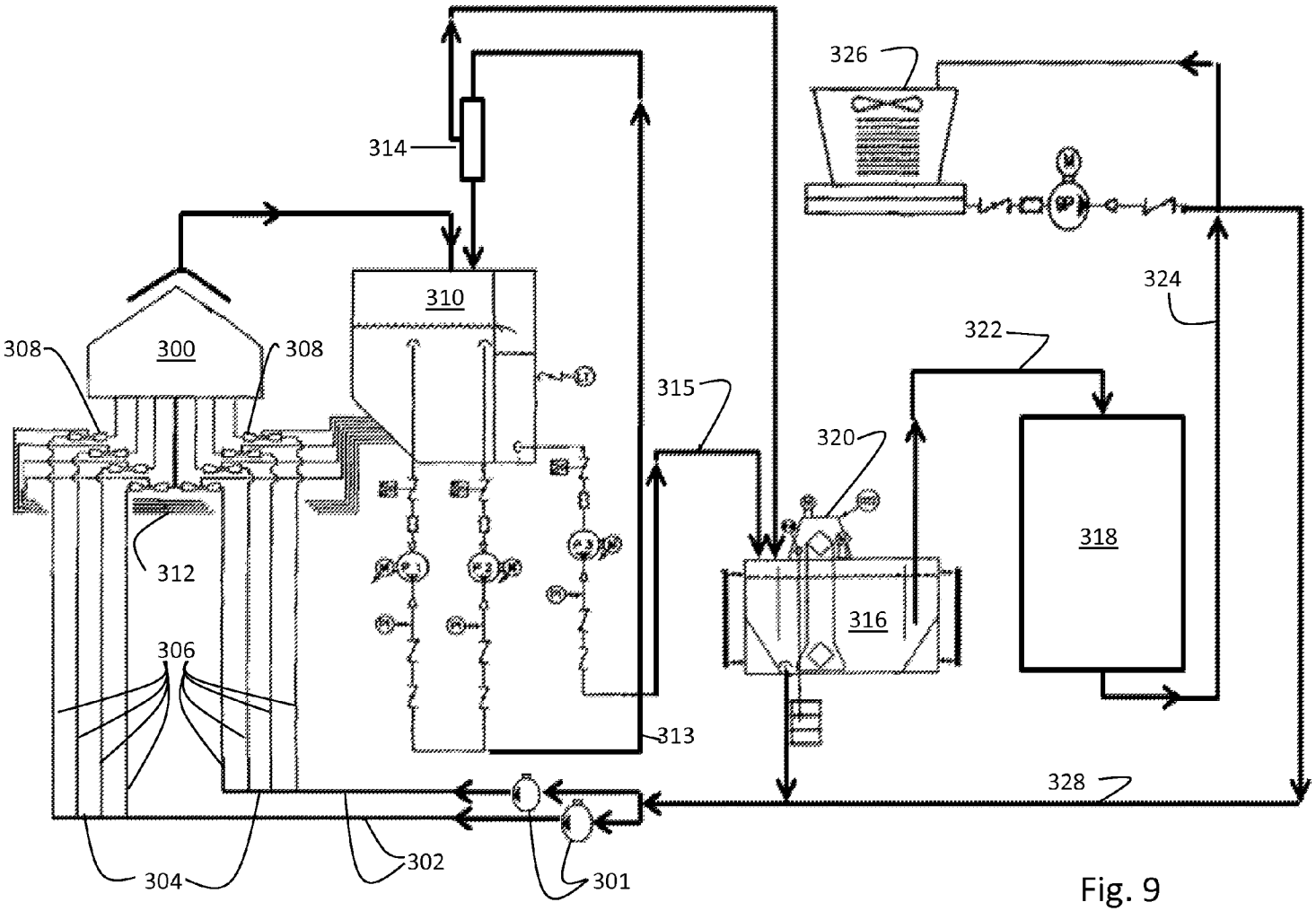
FIG. 9 is a schematic drawing showing components of the slurry delivery and recirculation system.

The grit to water ratio and grit flow rates may be controlled in a slurry delivery and recirculation system such as that shown schematically in FIG. 9. A descaling/blasting cell may have a slurry delivery and recirculation system that includes the use pumps and eductors that draw or meter required concentrations of grit and liquid. For instance, as shown in FIG. 9, the slurry mixture from the blast cabinet may be directed to a system of settling tanks, filters and magnetic separators where grit of a size and shape suitable for reuse is removed from the slurry for later use, and the remaining liquid mixture is filtered and separated in stages to remove expended grit, and scale, debris and other metals particles. The filtered and separated liquid may then be directed to a system of settling tanks with magnetic skimmers to ensure the liquid is predominately free of solids. The previously removed grit may then be re-mixed with the filtered and separated liquid to form the slurry mixture before injection into the blasting cell. In order to generate sufficient slurry flow through the descaling cell 300 to remove substantially all of the scale from the surfaces from the sheet metal, the inventors have found it necessary to generate between about 2,500 pounds per minute to about 5,000 pounds per minute of grit flow per blasting wheel. To generate this flow rate, the descaling cell system includes at least two primary eductor feed pumps 301, each generating a flow rate of 1,500 gallons per minute flowing through a 10 inch diameter inlet pipe 302. Each eductor feed pump may have a rating of 200 hp, 1750 rpm, and 150 psi at 1,500 gpm. Each eductor feed pump 301 directs its 1,500 per gallon flow rate to a manifold 304 with four outputs 306 that are directed to inlets of four of the eight blast wheels associated with the descaling cell. In a descaling cell comprising four top surface blasting wheels (i.e., 2 aft and 2 forward) and four bottom surface blasting wheels (i.e., 2 aft and 2 forward), one manifold 304 may feed the top two aft blast wheels and the bottom two aft blast wheels, and the second manifold 304 may feed the top two forward blast wheels and the bottom two forward blast wheels. The manifold 304 may comprises a 10 inch diameter pipe and each of the four outputs 306 may comprise 3 inch diameter pipe that is further narrowed to accommodate an eductor feed inlet comprising a 2½ inch diameter pipe. After passing through an eductor 308, the feed (usually water) is mixed with grit to form the slurry which is directed to the impeller of the blast wheel as described previously. After impacting the sheet metal in the descaling cell 300, the slurry is collected and directed to a hindering tank 310. The hindering tank provides a first stage of settling and cleaning of the discharged slurry and allows usable grit to be collected for reuse, and scale and other particulate matter to be further directed to secondary and tertiary settling and cleaning stages as may be necessary. Usable grit from the hindering tank is drawn through eductor suction lines 312 to the eductors 308 by action of the eductors 308, and combined with the liquid feed in the eductors to form the slurry injected into the blast wheels of descaling cell, as required. Each of the eductor suction lines 312 leading to the eductor suction inlet comprises a 4 inch diameter pipe that is expanded to a 6 inch diameter pipe at the hindering tank. The narrowing of the pipe size from the hindering tank (e.g., 6") to the eductor suction inlet (e.g., 4") provides a funneling effect for the grit thereby facilitating its flow from the hindering tank to the eductor suction inlet. Providing 4 inch diameter inlet piping for each of the blast wheels at the feed nozzle has been found effective. Also, providing a blast wheel diameter of 17½ inches (i.e., blade tip to blade tip diameter) has also been found effective.

A portion of the effluent 313 from the hindering tank 310 may recirculated between a cyclonic filtering system 314 and the hindering tank. Another portion of the effluent 315 from the hindering tank may be directed to secondary stage settling and cleaning equipment, comprising a settling tank 316 and filtration unit 318. The secondary settling tank 316 may have a system of magnetic skimmers and separators 320 to remove metal oxide and other fines from the process. Effluent 322 from the secondary stage settling tank may be directed to the secondary stage filtration system 318. Effluent 324 from the secondary stage filtration system 318 may then be directed to a cooling tower 326 where the effluent is cooled. The cooled and cleaned liquid 328 is then directed to the suction side of the eductor feed pumps 301 for further processing in the descaling cell 300.

Figure 10:
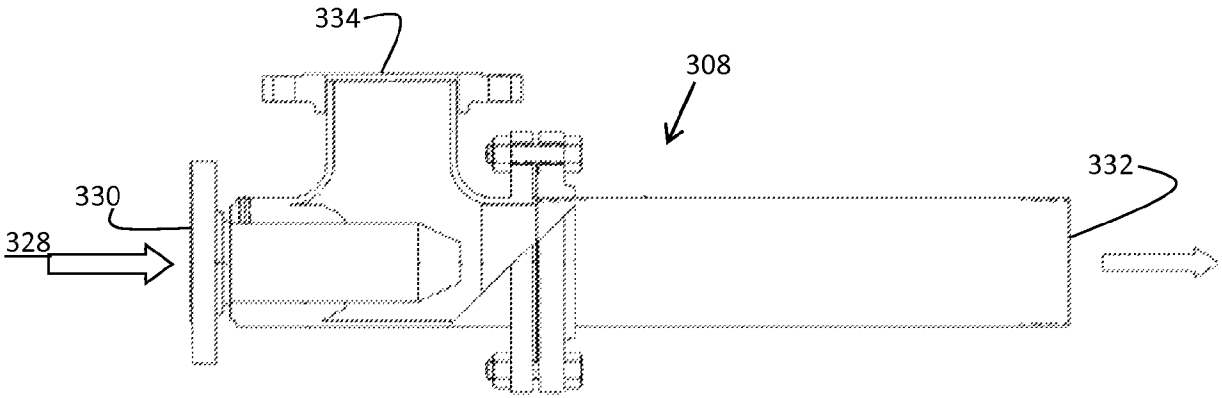
FIG. 10 is a cross sectional view of an eductor of the slurry delivery and recirculation system of FIG. 9.

FIG. 10 shows a cross-sectional view of an eductor 308 used to draw grit from the hindering tank 310 and allowing mixing with the cooled and cleaned feed liquid 328 to form the slurry. The inventors have found that the eductor system works well to generate the grit flow of about 2,500 pounds per minute to about 5,000 pounds per minute to allow substantially removing all of the scale from the processed sheet metal. As mentioned previously, the clean liquid feed inlet 330 of the eductor comprises a 2½ diameter opening that discharges to a 4 inch diameter outlet 332, with the eductor suction inlet 334 comprising a 4 inch diameter opening. An eductor rated for a flow of 425 gallons per minute at 125 psi for a feed liquid temperature of less than 130° F. has been found effective. To prevent fouling of the eductor, the liquid feed 328 is preferably clean, relatively cool (e.g.<130° F.) and free of solid particulate matter. While the system in FIG. 10 shows two stages of settling and cleaning of the liquid feed, the slurry delivery and recirculation system may comprise multiple stages of settling and cleaning as may be necessary to produce a sufficiently clean motive feed liquid for the slurry.

In the slurry delivery and recirculation system, corrosion inhibitors, for example, those marketed under the trademark "Oakite" by Oakite Products, Inc., may be added to the slurry.

Additive(s) may also introduced to the slurry to prevent oxidation of the steel grit. While additives may remain on the sheet metal after processing in the descaling cell, and provide a measure of rust protection, the inventors have found that sheet metal processed under the conditions described above exhibits satisfactory corrosion resistance without the addition of such corrosion inhibitors. Also, other additives may be added to the slurry to prevent the formation of fungi and other bacterial contaminants. An additive having the brand name "Power Clean HT-33-B" provided by Tronex Chemical Corp. of Whitmore Lake, Mich., has proven effective, providing both anti-bacterial and rust inhibitive qualities for the processed sheet metal and grit. An additive may be chosen based on the subsequent processing requirements of the sheet metal and the level of protection required. Also, if the incoming material has any oil on the surface, commercial alkaline or other cleaning or degreasing agents can be added to the slurry without changing the efficiency of the slurry blasting process.

As described in the related applications, the processing line may be configured such that the electric motors coupled to the impeller wheels in the first cell shown to the left in FIG. 1 rotate at a faster speed than the impeller wheels in the second cell shown to the right of FIG. 1. In this configuration, the slurry discharged from the first cell will impact the material 16 with a greater force and remove substantially all of the scale from the surfaces of the material, and the slurry discharged from the second cell will impact the material at a reduced force and will generate smoother surfaces, preferably with rust inhibitive properties. To produce rust inhibitive material, the speeds used in the second cell would preferably be in the ranges disclosed above with the slurry constituencies described above. In another configuration, the grit employed in the slurry discharged from each of the cells 26 may be of different sizes. In this configuration, a larger grit in the slurry discharged from the first cell would impact the surfaces of the material to substantially remove all of the scale from the surfaces of the material, and a slurry mixture having the grit components and grit to water ration described above may be used in the second cell to generate smoother surfaces preferably with rust inhibitive properties. Alternatively, the rotational speed of the impeller wheels of the first cells to propel the slurry toward the sheet metal may be faster than the rotation speed of the wheels of the second cells. This would also result in the slurry propelled by the first cell impacting the surface of the sheet metal to remove substantially all of the scale from the surface. The subsequent impact of the slurry propelled by the slower rotating wheels of the second cell with the operating parameters described above would impact the surface of the sheet metal and create a smoother surface preferably with rust inhibitive properties. In the processing lines described in the related application, two blasting cells are positioned sequentially in the path of the sheet metal passing through the line of the apparatus to efficiently remove scale and provide processed sheet metal with rust inhibitive properties. However, it should be appreciated that only one blasting cell, configured as described above may be used.

Although an end user may desire sheet metal with rust inhibitive properties, the end user may also desire sheet metal with a top surface texture different from a bottom surface texture. It should also be appreciated that the opposite surfaces of the length of sheet metal may be processed by the apparatus differently, for example, by employing different scale removing medium supplied to the wheels above and below the length of sheet metal passed through the apparatus, and/or using any of the techniques discussed above. Different target textures on the opposite surfaces of the sheet metal strip is often a requirement where an inner surface of a part has a major requirement to carry a heavy coating of lubricant for drawing and then to support a heavy polymer coating for wear and corrosion protection, and the outside surface needs to provide an attractive smooth painted surface. For example, body panels for luxury automobiles often have this type of requirement. The ability to adjust the surface texture of the sheet is important because a rougher surface texture normally increases a coating's adhesion, but requires more coating. The adjustability feature enables the operator of the processing line to adjust the surface texture for the condition desired, i.e., adhesion or coating, while providing the desired rust inhibitive properties for the surface.

To assist in control of the processing line, an in-line detector 160 may be used to detect a surface condition of the top and/or bottom surfaces of the processed sheet metal after passing through the descaling cell(s), and an output of the in-line detector may be used to assist the processing line operator in adjusting any one or more of the following to obtain a desired surface condition: (i) pivoting, rotating, angling, and/or positioning the top surface impeller wheel(s) of the first blasting cell ; (ii) pivoting, rotating, angling, and/or positioning the bottom surface impeller wheel(s) of the first blasting cell; (iii) pivoting, rotating, angling, and/or positioning the top surface impeller wheel(s) of the second blasting cell, (iv) pivoting, rotating, angling, and/or positioning the bottom surface impeller wheel(s) of the second blasting cell, (v) increasing or decreasing the processing line speed; or (iv) actuating the actuator to rotate the feed nozzle relative to the impeller of each blast wheel to adjust the center of intensity of the blast pattern. The in-line detector may be positioned between the two blasting cells 26 or may be positioned after the second blasting cell as shown in FIG. 1. For example, the detector may comprise an oxide detector positioned downstream in the processing line after the two blasting cells and adapted to detect the level of scale remaining on both the top and bottom surfaces of the strip, and based at least in part upon a detected surface condition (i.e., the level of scale detected), adjustments may be made to the first or second cell operation (i.e., impeller wheel speed, impeller wheel angles, impeller wheel position), or processing line speed (i.e., a rate of sheet metal advancement through the descaler). One such oxide detector is disclosed in U.S. Pat. App. Pub. No. 2009/0002686, the disclosure of which is incorporated by reference herein. The detector may also be a surface finish detector, i.e., a profilometer, and the surface condition to be detected and controlled may correspond to surface finish. The detector may also comprise a machine vision system, and the surface condition to be detected and controlled may correspond to surface flaws in the processed sheet, for instance, blemishes, slivers, residue, metallic smut, an agglomeration of loose scale, wear debris, etc. One or more detectors may be used to detect a surface condition of the top surface and bottom surface of the sheet metal. A combination of surface conditions may be detected, and the operating parameters of each of the cells may be varied to attain the surface condition(s) desired.

In another embodiment of the descaling cell, the detector 160 may be provided with automatic feedback mechanism that allows for automatic control of processing line operating parameters based at least in part of the detected surface condition. For instance, based upon the detected surface condition, the rate of slurry impact may be controlled to produce a specific surface condition, for instance, a surface finish less than about 100 Ra. The rate of slurry impact may be varied by varying the discharge velocity of the propelled slurry or by varying the processing line speed, i.e., the speed at which the sheet steel is advanced through the line. Thus, based at least in part of the detected surface condition, a rate of advancement of the sheet material through the descaling cell may be changed as desired. In addition to or in the alternative, a discharge rate of slurry being propelled against the side of the sheet metal may be varied as necessary based at least in part upon the detected surface condition. For a system involving centrifugal impellers, the impeller wheel velocity may be changed based at least in part of the detected surface condition. Generally speaking, to obtain a desired surface condition, any one or more of the following may be changed based at least in part upon the detected surface condition: (i) pivoting, rotating, angling, and/or positioning the top surface impeller wheel(s) of the first blasting cell ; (ii) pivoting, rotating, angling, and/or positioning the bottom surface impeller wheel(s) of the first blasting cell; (iii) pivoting, rotating, angling, and/or positioning the top surface impeller wheel(s) of the second blasting cell, (iv) pivoting, rotating, angling, and/or positioning the bottom surface impeller wheel(s) of the second blasting cell, (v) increasing or decreasing the processing line speed; or (iv) actuating the actuator to rotate the feed nozzle relative to the impeller of each blast wheel to adjust the center of intensity of the blast pattern. One or more detectors may be used to detect a surface condition of the top surface and bottom surface of the sheet metal, and a top surface detected surface condition and/or a bottom surface detected surface condition may provide input to the automated processing line control system. A surface finish in excess of 100 Ra may also be desired, for instance, where the sheet metal is to be used in a painting application.

As disclosed in the related applications, the processing line may also comprise a brusher cell 122 positioned adjacent the blasting cell 26 to receive the length of sheet metal 16 from the descalers. The brusher 122 could be of the type disclosed in the U.S. patent of Voges U.S. Pat. No. 6,814,815, which is incorporated herein by reference. The brusher 122 comprises pluralities of rotating brushes arranged across the width of the sheet metal 16. The rotating brushes contained in the brusher 122 contact the opposite top 106 and bottom 108 surfaces of the length of sheet metal 16 as the sheet metal passes through the brusher 122, and produce a unique brushed and blasted surface, generally with a lower roughness, with some directionality. The brushes act with water sprayed in the brusher 122 to process the opposite surfaces of the sheet metal, adjusting or modifying the texture of the surfaces created by the blasting cells 26. A brush unit may be installed downstream of the blasting cells to reduce surface roughness (Ra). Alternatively, the brusher 122 could be positioned upstream of the blasting cells 26 to receive the length of sheet metal 16 prior to the descalers. In this positioning of the brusher 122, the brusher would reduce the workload on the blasting cells 26 in removing scale from the surfaces of the sheet metal 16. However, it is preferred that the brushers be positioned downstream of the descalers. It should be appreciated that the processing line need not have a brushing unit.

The processing line may also comprise a dryer 124 positioned adjacent the brusher 122 to receive the length of sheet metal 16 from the brusher, or directly from the slurry blaster if the brushing unit is not installed or is deselected. The dryer 124 dries the liquid from the surfaces of the length of sheet metal 16 as the sheet metal passes through the dryer. The liquid is residue from the rinsing process. It should be appreciated that the processing line need not have a dryer.

The processing line may also comprise a coiler 126 that receives the length of sheet metal 16 from the dryer 124 and winds the length of sheet metal into a coil for storage or transportation of the sheet metal. To facilitate removing substantially all of the scale from the surface of the sheet metal, the sheet metal may be placed under tension as it is drawn through the descaling cells. The tension may be provided by the coiler 126, for instance, as described in co-pending application Ser. No. 12/332,803, filed Dec. 11, 2008. The tension may also be applied via a bridal roller and/or tension leveler, or other device which changes the advancement rate of the sheet metal along the line to produce elongation in the sheet metal as it passes through the descaling cell(s). Preferably, the sheet metal is elongated up to 0.5% as it is processed through the blasting cells. Because elongating the sheet metal facilitates scale removal performed in the blasting cells, the relative speed of the processing line may be increased.

In alternative line configurations/embodiments, the length of sheet metal processed by the apparatus may be further processed by a coating being applied to the surfaces of the sheet metal, for example a galvanizing coating or a paint coating. The length of sheet metal could also be further processed by running the length of sheet metal through the line apparatus shown in FIG. 1 a second time.

Figure 11:
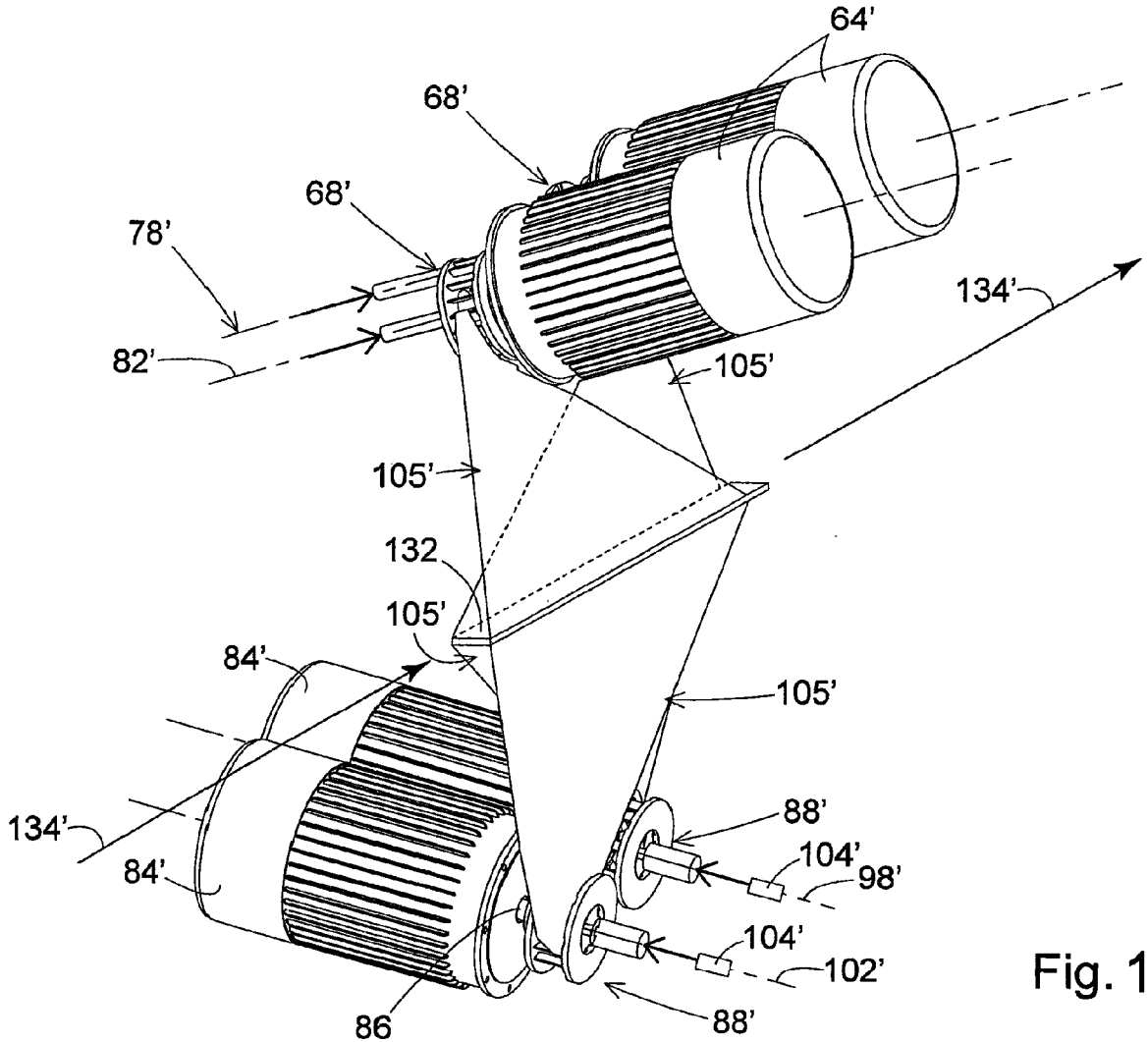
FIG. 11 is a representation of an embodiment of the descaler that removes scale from a narrow, thin strip of material.

The apparatus may also be employed in removing scale from material that is in an other form than a sheet of material. FIG. 11 depicts the apparatus employed in removing scale from the exterior surfaces of narrow, thin strip material 132, for example, metal strip that is later formed into tubing, or wire or bar stock. In the variant embodiment of the apparatus shown in FIG. 11, the same descalers of the previously described embodiments of the invention are employed. The same reference numbers are employed in identifying the component parts and the positional relationships of the previously described embodiments of the invention, but with the reference numbers being followed by a prime ('). In FIG. 11, the length of strip 132 is moved through the descaling apparatus in the direction indicated by the arrows 134. It can be seen that the orientations of the impellor wheels 68', 88' are such that they will propel the scale removing medium 105' where the width of the contact area of the scale removing medium 105' extends along the length of the strip 132. Apart from the above-described differences, the embodiment of the apparatus shown in FIG. 11 functions in the same manner as the previously described embodiments in removing scale from the surface of metal strip 132. Alternatively, the pair of rotating wheels can be adjustably positioned closer to the opposite surfaces of the strip of material so that the widths of the blast zones is just slightly larger than the width of the strip surfaces. In this alternative the speed of the wheels would be decreased slightly to compensate for the increase in the blasting force due to moving the wheels closer to the surfaces of the strip sheet metal.

To enable the sheet metal processing line to be expanded to support an additional descaling or blasting cell, or other piece of equipment, the components of the processing line, including the descaling cells, may be mounted on a rail or I-Beam system 170 (FIG. 1). The rail or I-Beam comprises rails that extend along the facility at a floor level. Each component has mounts 172 (FIG. 1) that engage and/or locate on the rail system, thus facilitating axial movement and alignment of the components of the processing line. When a component is to be removed or added, the line may be opened and the component to be removed or added may be moved down the rail system thereby reducing downtime associated with changes to the processing line. By providing a rail system, the processing line may extend across the floor or another support surface of a facility, thus eliminating floor pits that are customarily used for accommodating large components of a processing line. Generally, floor pits are expensive to construct and they reduce an operator's flexibility in altering the configuration of a processing line. Providing a I-beam or rail system for mounting the processing line components increases operational flexibility, and allows the operator of a processing line to scale the processing line as may be desired with the addition or removal of blasting cells or other ancillary equipment.

The inventors have determined that processing steel sheet metal through the slurry blasting descaling cell described above under the conditions described above allows for the processing of sheet metal with rust inhibitive properties. Carbon steel used in a hot rolling process typically contains trace amounts of the elements Aluminum, Chromium, Manganese, and Silicon. For instance, common hot rolled carbon steel may have a chemical composition: Al-0.03%; Mn-0.67%; Si-0.03%; Cr-0.04%, C-remainder. The inventors have determined that processing steel using one or more of the descaling methods discussed above creates a very thin passivation layer (~200 Å (Angstroms)) in the steel substrate comprising one or more of the above mentioned trace elements, thus enabling the processed steel sheet to exhibit rust inhibitive properties. The inventors have also determined that processing steel using one or more of the descaling methods discussed above removes substantially of the scale from the surfaces of the sheet metal.

Although the apparatus and the method of the invention have been described herein by referring to several embodiments of the invention, it should be understood that variations and modifications could be made to the basic concept of the invention without departing from the intended scope of the following claims.

What is claimed is:

1. An apparatus that removes scale from sheet metal, the apparatus comprising:

a descaler that receives lengths of sheet metal and removes scale from at least one surface of the length of sheet metal as the length of sheet metal is moved in a first direction through the descaler;

a supply of a scale removing medium communicating with the descaler and supplying the scale removing medium to the descaler, the scale removing medium comprising a grit;

a pair of wheels on the descaler positioned adjacent the at least one surface of the length of sheet metal passed through the descaler, a first wheel and a second wheel of the pair of wheels having respective first and second axes of rotation, the first wheel and the second wheel being positioned on the descaler to receive the scale removing medium from the supply of scale removing medium; and at least one motive source operatively connected to the first wheel and the second wheel to rotate the first wheel and the second wheel whereby rotation of the first wheel causes the scale removing medium received by the first wheel to be propelled from the first wheel against the at least one surface across substantially an entire width of the length of sheet metal passed through the descaler and rotation of the second wheel causes the scale removing medium received by the second wheel to be propelled from the second wheel against the at least one surface across substantially an entire width of the length of sheet metal passed through the descaler;

wherein the first wheel rotates in a first rotary direction and the second wheel rotates in a second rotary direction, the first rotary direction being opposite to the second direction;

wherein the second wheel is spaced from the first wheel along the first direction a distance sufficient such that the scale removing medium propelled from the second wheel does not substantially interfere with the scale removing medium propelled from the first wheel;

wherein the first wheel and the second wheel are positioned adjacent opposite side edges defining the width of the sheet metal with the sheet metal centered between the first wheel and the second wheel;

wherein the scale removing medium is propelled from its respective wheel to the sheet metal in a velocity range of about 100 feet per second to 200 feet per second; and wherein scale removing medium impacts against the at least one of the top surface and bottom surface of the sheet metal in a manner to remove substantially all of the scale from a surface of the sheet metal.

2. The apparatus of claim 1, wherein the grit comprises an SAE size of G80 to an SAE size of G40.

3. The apparatus of claim 1, wherein the grit comprises a SAE size of G50.

4. The apparatus of claim 1, wherein the scale removing medium impacts the at least one of the top and bottom surfaces in manner to produce a surface finish greater than about 100 Ra.

5. The apparatus of claim 1, wherein the sheet metal is elongated as it enters the apparatus.

6. The apparatus of claim 1, wherein the scale removing medium comprises a slurry.

7. A method of removing scale from a length of sheet metal comprising:

positioning a first wheel having a first axis of rotation adjacent a first surface of the length of sheet metal;

positioning a second wheel having a second axis of rotation adjacent the first surface of the length of sheet metal;

supplying a scale removing medium to the first wheel and to the second wheel, the scale removing medium comprising grit particles;

rotating the first wheel about the first rotation axis whereby the scale removing medium supplied to the first wheel is propelled by the rotating first wheel against a first area extending across substantially an entire width of the first surface of the length of sheet metal;

rotating the second wheel about the second rotation axis whereby the scale removing medium supplied to the second wheel is propelled by the rotating second wheel against a second area of the first surface extending across substantially an entire width of the length of sheet metal;

rotating the first wheel and the second wheel in opposite directions and in a manner such that the scale removing medium is propelled from its respective wheel to the sheet metal in a velocity range of about 100 feet per second to 200 feet per second;

positioning the first wheel and the second wheel relative to the length of sheet metal where the first area is spaced from the second area along the length of sheet metal;

positioning the first wheel and the second wheel along adjacent opposite side edges defining a width of the sheet metal with the sheet metal centered between the first wheel and the second wheel; and controlling a rate of scale removing medium impact against the at least one of the top surface and bottom surface of the sheet metal in a manner to remove substantially all of the scale from a surface of the sheet metal.

8. The method of claim 7, wherein the grit is supplied to each of the wheels comprises an SAE size of G80 to an SAE size of G40.

9. The method of claim 7, wherein the grit has an SAE size of G50.

10. The method of claim 7, wherein the rate of scale removing medium impact against the at least one of the top and bottom surfaces is controlled in manner to produce a surface finish greater than about 100 Ra.

11. The method of claim 7, further comprising elongating the sheet metal.

12. The method of claim 7, wherein the scale removing medium comprises a slurry.

13. An apparatus that removes scale from sheet metal, the apparatus comprising:

a descaler that receives a length of sheet metal, the sheet metal having a width that is transverse to the sheet metal length, the descaler being operable to remove scale from a top surface and a bottom surface of the length of sheet metal completely across the width of the length of sheet metal as the length of sheet metal passes through the descaler;

a scale removing supply communicating with the descaler and supplying a scale removing medium to the descaler and removing and recirculating the scale removing medium supplied to the descaler, the scale removing medium comprising a grit;

a first rotatable impeller wheel having an axis of rotation, the wheel being positioned on the descaler to receive the scale removing medium supplied by the scale removing supply and centrifugally propel the scale removing medium against the top surface of the length of sheet metal in an impact area that extends completely across the width of the length of sheet metal as the length of sheet metal passes through the descaler;

a second rotatable impeller wheel having an axis of rotation different from the first rotatable impeller wheel axis of rotation, the second rotatable impeller wheel being positioned on the descaler to receive the scale removing medium supplied by the scale removing supply and centrifugally propel the scale removing medium against the top surface of the length of sheet metal in an impact area that extends completely across the width of the length of sheet metal as the length of sheet metal passes through the descaler;

a third rotatable impeller wheel having an axis of rotation, the wheel being positioned on the descaler to receive the scale removing medium supplied by the scale removing supply and centrifugally propel the scale removing medium against the bottom surface of the length of sheet metal in an impact area that extends completely across the width of the length of sheet metal as the length of sheet metal passes through the descaler;

a fourth rotatable wheel having an axis of rotation different from the third rotatable wheel axis of rotation, the fourth rotatable wheel being positioned on the descaler to receive the scale removing medium supplied by the scale removing supply and centrifugally propel the scale removing medium against the bottom surface of the length of sheet metal in an impact area that extends completely across the width of the length of sheet metal as the length of sheet metal passes through the descaler;

wherein the first and second wheels are positioned as symmetrical mirror images across the width of the length of the top surface of the sheet metal and centrifugally propel the scale removing medium against the top surface of the length of sheet metal in symmetrical, mirror image patterns of propelled scale removing medium across the width of the length of sheet metal;

wherein the third and fourth wheels are positioned as symmetrical mirror images across the width of the length of the bottom surface of the sheet metal and centrifugally propel the scale removing medium against the bottom surface of the length of sheet metal in symmetrical, mirror image patterns of propelled scale removing medium across the width of the length of sheet metal;

wherein the second wheel is spaced from the first wheel along the length of the sheet metal a distance sufficient such that the scale removing medium propelled from the second wheel does not substantially interfere with the scale removing medium propelled from the first wheel; and wherein the first wheel and the second wheel are positioned adjacent opposite side edges of the width of sheet metal with the sheet metal centered between the first wheel and the second wheel;

wherein the third wheel is spaced from the fourth wheel along the first direction a distance sufficient such that the scale removing medium propelled from the third wheel does not substantially interfere with the scale removing medium propelled from the fourth wheel;

wherein the third wheel and the fourth wheel are positioned adjacent opposite side edges of the width of sheet metal with sheet metal centered between the third wheel and the fourth wheel;

wherein the scale removing medium is propelled from its respective wheel to the sheet metal in a velocity range of about 100 feet per second to 200 feet per second; and wherein the scale removing medium impacts against the top and bottom surfaces of the sheet metal in a manner to remove substantially all of the scale from the top and bottom surfaces of the sheet metal.

14. The apparatus of claim 13, wherein the grit comprises an SAE size of G80 to an SAE size of G40.

15. The apparatus of claim 13, wherein the grit comprises an SAE size of G50.

16. The apparatus of claim 13, wherein the sheet metal is elongated as slurry is propelled against the sheet metal.

17. The apparatus of claim 13, wherein the scale removing medium comprises a slurry.

18. A method of blasting metal comprising:

positioning a first wheel having a first axis of rotation adjacent a first surface of a metal object;

positioning a second wheel having a second axis of rotation adjacent the first surface of the metal object, the second axis of rotation being different from the first axis of rotation;

supplying a scale removing medium comprising a grit to the first wheel and the second wheel; and, rotating the first and second impeller wheels about the respective first and second axes of rotation in a manner such that the scale removing medium supplied to the first and second impeller wheels is propelled by the rotating first and second impeller wheels against a respective first area and second area of the first surface of the metal object;

positioning a third impeller wheel having a third axis of rotation adjacent a second surface of the metal object that is opposite the first surface of the metal object; positioning a fourth impeller wheel having a fourth axis of rotation adjacent the second surface of the metal object, the fourth axis of rotation being different from the third axis of rotation;

supplying the scale removing medium to the third wheel and the fourth wheel; and rotating the third wheel and the fourth impeller wheel about the respective third and fourth axes of rotation in a manner such that the scale removing medium supplied to the third and fourth impeller wheels is propelled by the rotating third and fourth impeller wheels against a respective third area and fourth area of the second surface of the metal object;

controlling a rate at which the scale removing medium impacts against the top and bottom surfaces of the sheet metal in a manner to remove substantially all of the scale from the top and bottom surfaces of the sheet metal;

wherein the scale removing medium is propelled from its respective wheel to the sheet metal in a velocity range of about 100 feet per second to 200 feet per second;

wherein the first and second impeller wheels are positioned such that the first and second areas are symmetrical mirror images across a width of the sheet metal, and the third and fourth impeller wheels are positioned such that the third and fourth areas are symmetrical mirror images across a width of the second surface of the sheet metal;

wherein the second wheel is spaced from the first wheel along the length of the first surface of the sheet metal a distance sufficient such that the scale removing medium propelled from the second wheel does not substantially interfere with the scale removing medium propelled from the first wheel; and wherein the first wheel and the second wheel are positioned adjacent opposite side edges defining the width of the sheet metal with the sheet metal centered between the first wheel and the second wheel;

wherein the third wheel is spaced from the fourth wheel along the length of the sheet metal a distance sufficient such that the scale removing medium propelled from the third wheel does not substantially interfere with the scale removing medium propelled from the fourth wheel; and wherein the third wheel and the fourth wheel are positioned adjacent opposite side edges defining the width of the sheet metal with the sheet metal centered between the third wheel and the fourth wheel.

19. The method of claim 18, wherein the grit comprises an SAE size of G80 to an SAE size of G40.

20. The method of claim 18, wherein the grit comprises a SAE size of G50.

21. The method of claim 18, further comprising elongating the sheet metal.

22. The method of claim 18, wherein the scale removing medium comprises a slurry.

* * * * *